US009139265B2

(12) United States Patent
Peberdy

(10) Patent No.: US 9,139,265 B2
(45) Date of Patent: Sep. 22, 2015

(54) FIN ASSEMBLY

(75) Inventor: Scott Peberdy, San Remo (AU)

(73) Assignee: Slide Fins Pty Ltd, San Remo (AU)

( * ) Notice: Subject to any disclaimer, the term of this patent is extended or adjusted under 35 U.S.C. 154(b) by 0 days.

(21) Appl. No.: 13/811,571

(22) PCT Filed: Jul. 20, 2011

(86) PCT No.: PCT/AU2011/000912

§ 371 (c)(1),
(2), (4) Date: Apr. 2, 2013

(87) PCT Pub. No.: WO2012/009753

PCT Pub. Date: Jan. 26, 2012

(65) Prior Publication Data

US 2013/0183152 A1 Jul. 18, 2013

(30) Foreign Application Priority Data

Jul. 20, 2010 (AU) ..... 2010903227

(51) Int. Cl.
*B63B 35/79* (2006.01)
*B63B 39/06* (2006.01)

(52) U.S. Cl.
CPC ..... *B63B 35/7926* (2013.01); *B63B 35/793* (2013.01); *B63B 39/06* (2013.01); *B63B 2039/065* (2013.01)

(58) Field of Classification Search
CPC B63B 35/79; B63B 35/7906; B63B 35/7926; B63B 35/793; B63B 35/7933; B63B 39/06; B63B 36/061; B63B 39/062; B63B 41/00; B63B 2039/065
USPC ..... 441/74, 79; 114/127–140, 143, 152
See application file for complete search history.

(56) References Cited

U.S. PATENT DOCUMENTS

| | | | | |
|---|---|---|---|---|
| 4,811,674 | A * | 3/1989 | Stewart | 441/79 |
| 5,664,979 | A | 9/1997 | Benham | |
| 5,813,890 | A * | 9/1998 | Benham | 441/79 |
| D428,459 | S * | 7/2000 | Broz et al. | D21/769 |
| 7,740,512 | B1 * | 6/2010 | Patterson | 441/74 |
| 8,408,958 | B2 * | 4/2013 | Benham | 441/79 |
| 2004/0248482 | A1 * | 12/2004 | Larkin | 441/79 |
| 2010/0323568 | A1 * | 12/2010 | Chambers | 441/79 |

FOREIGN PATENT DOCUMENTS

| | | | | |
|---|---|---|---|---|
| FR | 2594785 | A1 * | 8/1987 | B63B 35/79 |
| WO | 2005/105566 | A1 | 11/2005 | |

OTHER PUBLICATIONS

International Search Report of the International Searching Authority mailed Aug. 15, 2011, in corresponding International Patent Application No. PCT/AU2011/000912, filed Jul. 20, 2011, 2 pages.

* cited by examiner

*Primary Examiner* — Ajay Vasudeva
(74) *Attorney, Agent, or Firm* — Christensen O'Connor Johnson Kindness PLLC

(57) ABSTRACT

A fin assembly for controlling movement of a buoyant body, including: a base for attaching the assembly to the body; and a fin attached to the base by a hinge, wherein when the assembly is attached to the body, the fin can pivot at the hinge from a first condition to a second condition to allow substantially free rotation of the body in a first rotational direction.

18 Claims, 10 Drawing Sheets

FIN ASSEMBLY

FIELD

The present invention relates to a fin assembly for controlling the movement of a buoyant body.

BACKGROUND

Many recreational water sports use buoyant bodies such as surfboards, body boards, and skis to allow the user to glide across the surface of the water. To provide an element of control, fins are mounted to the base of the buoyant bodies, generally towards the rear.

With regard to surfboards, modern fins are provided as assemblies which are removably coupled to the underside of the surfboard. Other fins are formed with the surfboard, though such fins are difficult to repair and provide no distinct advantages over removable fins.

Fins in general serve to direct the flow of water so as to stabilise the buoyant body and allow it to be controlled by the user. This stability is largely afforded by preventing rotation of the rear of the body, so that the rear of the body follows the front of the body as it is directed by the user. Thus the body cannot simply rotate. However, by preventing rotation, fins also make it exceedingly difficult to perform tricks, such as 360° turns and slides, for which rotation is desirable. Such manoeuvres can generally only be performed with luck or by an experienced and skilful surfer applying sufficient force with appropriate timing and positioning of weight on the body.

Desired, therefore, is a fin assembly that prevents rotation so as to provide control over the buoyant body, but that also allows substantially unhindered rotation to afford manoeuvrability and tricks to be performed.

SUMMARY OF THE INVENTION

According to the invention, there is provided a fin assembly for controlling movement of a buoyant body, including:

a base for attaching the assembly to the body; and a fin attached to the base by a hinge, wherein when the assembly is attached to the body, the fin can pivot at the hinge from a first condition to a second condition to allow substantially free rotation of the body in a first rotational direction.

Preferably, the fin stands substantially upright from the body when the fin is in the first condition.

Preferably, a plane of the fin is substantially parallel to a plane of the body when the fin is in the second condition.

Preferably, the fin assembly is removably attachable to the buoyant body. Alternatively, the fin assembly may be integral with the buoyant body.

Preferably, the hinge is biased to move the fin towards the first condition.

Preferably, the base and fin form a continuous body of material and the hinge is at least partially formed by one or more of:

a thinning of the material;

a weakening in the material; and a different material to that of the base and fin.

Advantageously, the present invention allows rotation of the buoyant body in one direction, whilst providing substantially unaffected control of the movement of the buoyant body in other directions. Accordingly, manoeuvres that would otherwise be difficult to perform with a rigid fin attached to a buoyant body, such as 360° turns and slides, can be performed with considerably greater ease using the fin assembly of the present invention.

Also described herein in a fin assembly comprising a base and a fin that are removably attachable to form a rigid fin assembly.

Advantageously, a rigid fin assembly as described above may enable the fin to be exchanged to suit a particular wave, or to be replaced when damaged.

BRIEF DESCRIPTION OF THE DRAWINGS

Preferred embodiments will now be described by way of non-limiting example only, with reference to the accompanying drawings, in which.

DETAILED DESCRIPTION

Figure 1:
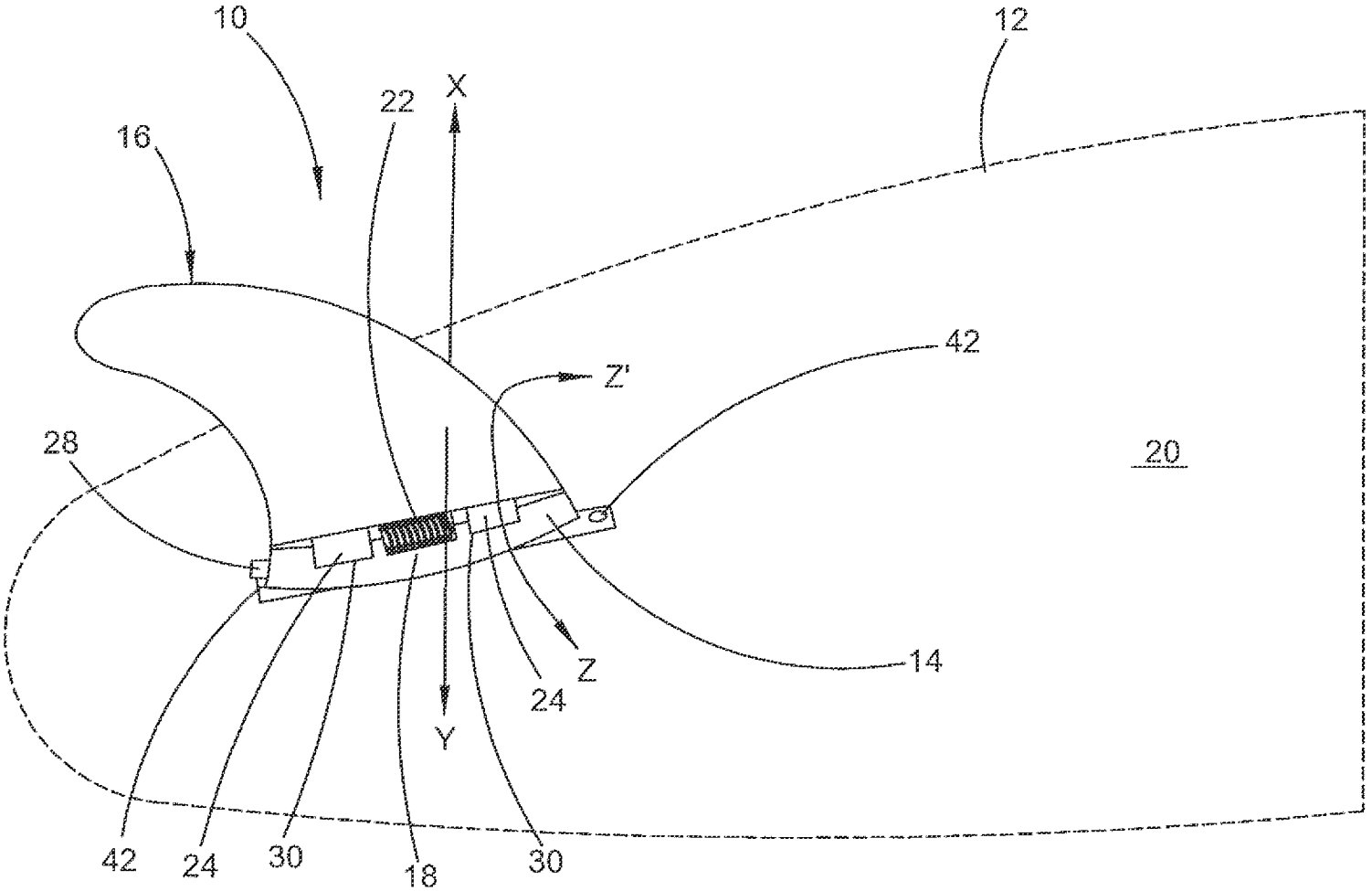
FIG. 1 is a perspective view of a fin assembly in a first condition.

A fin assembly 10, as shown in FIG. 1, for controlling movement of a buoyant body 12 (in the present case a surfboard as indicated in broken lines), includes a base 14 for attaching the assembly 10 to the body 12. A fin 16 is attached to the base 14 by a hinge 18.

The fin 16 can at the hinge from a first condition as shown to a second condition to allow substantially free rotation of the body in a first rotational direction Y.

Figure 2:
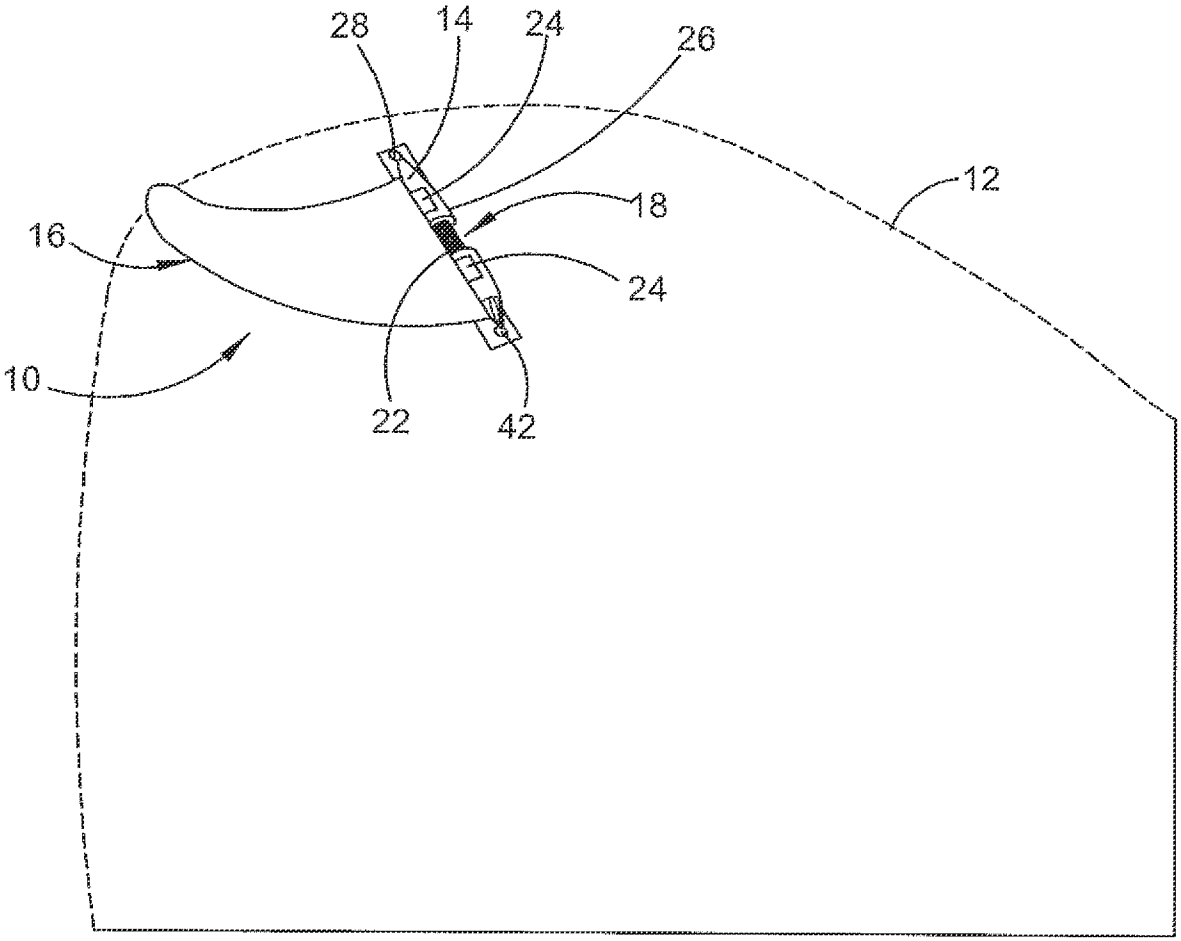
FIG. 2 is a perspective view of the fin of FIG. 1 in a second condition.
Figure 12:
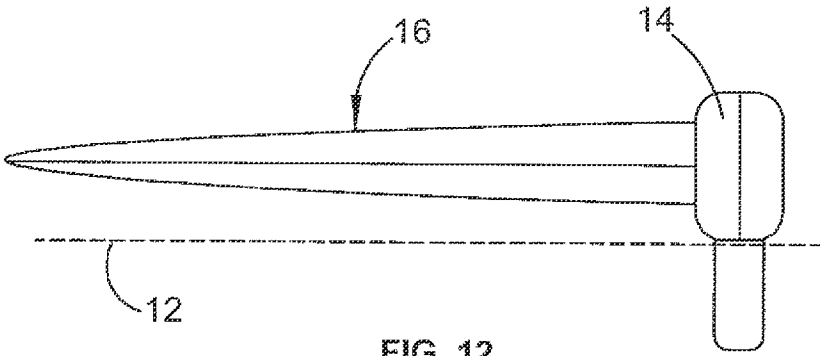
FIG. 12 is a front view of a fin assembly with the fin in a second condition.

In the present embodiment, in the first condition the fin 16 extends from the base 14 substantially perpendicularly to the plane (or underside) of the surfboard 12, and is rotatable to a second condition as shown in perspective in FIG. 2 and in a front view in FIG. 12. In the first condition, the assembly assists in controlling rotation of the surfboard 12 in the rotational direction indicated by arrow X (which is opposite to the rotational direction indicated by arrow Y) in a similar manner to the control afforded by a traditional fin (not shown), since the blade 32 (see FIG. 4) extends into the water presenting a surface against which water pressure can be applied and which resists rotation of the body 12. In the second condition, the fin 16 and thus the blade 32 no longer present such a large surface area to the water and therefore substantially free rotation of the surfboard 12 in the direction of arrow Y can be achieved. It is preferred, though not essential, that in the second condition the blade 32 presents no opposition to rotation in the direction Y and/or is coplanar with or hidden with the body 12.

The hinge 18 is biased to move the fin 16 to either the first condition or the second condition. Generally, the hinge 18 will be biased to move the fin 16 towards the first condition. In the present embodiment, the hinge 18 includes a helical spring 22 (though any other spring or mechanism may be used as appropriate) which biases the fin 16 towards the first condition, being the condition of normal use of the fin 16.

The hinge further includes an axle or pin 28 extending through the base 14 and fin 16, so that the fin 16 can rotate about the axle 28 between the first and second conditions. To receive the axle or pin 28, the fin 16 includes a pair of projections or hinge tabs 24, through which the pin 28 extends. The tabs 24 stabilise the hinge 18 when in the first condition, in which tabs 24 abut the side 26 of the base 14. To assist in this stability, when the hinge 18 includes a helical spring 22 it is generally desirable that the axle or pin 28 is coaxial with an axis of the helical spring (e.g. the axle or pin 28 may extend through the helical spring 22), so that force applied by the spring 22 to either of the base 14 and fin 16 is not eccentric with respect to the axle 28.

Figure 3:
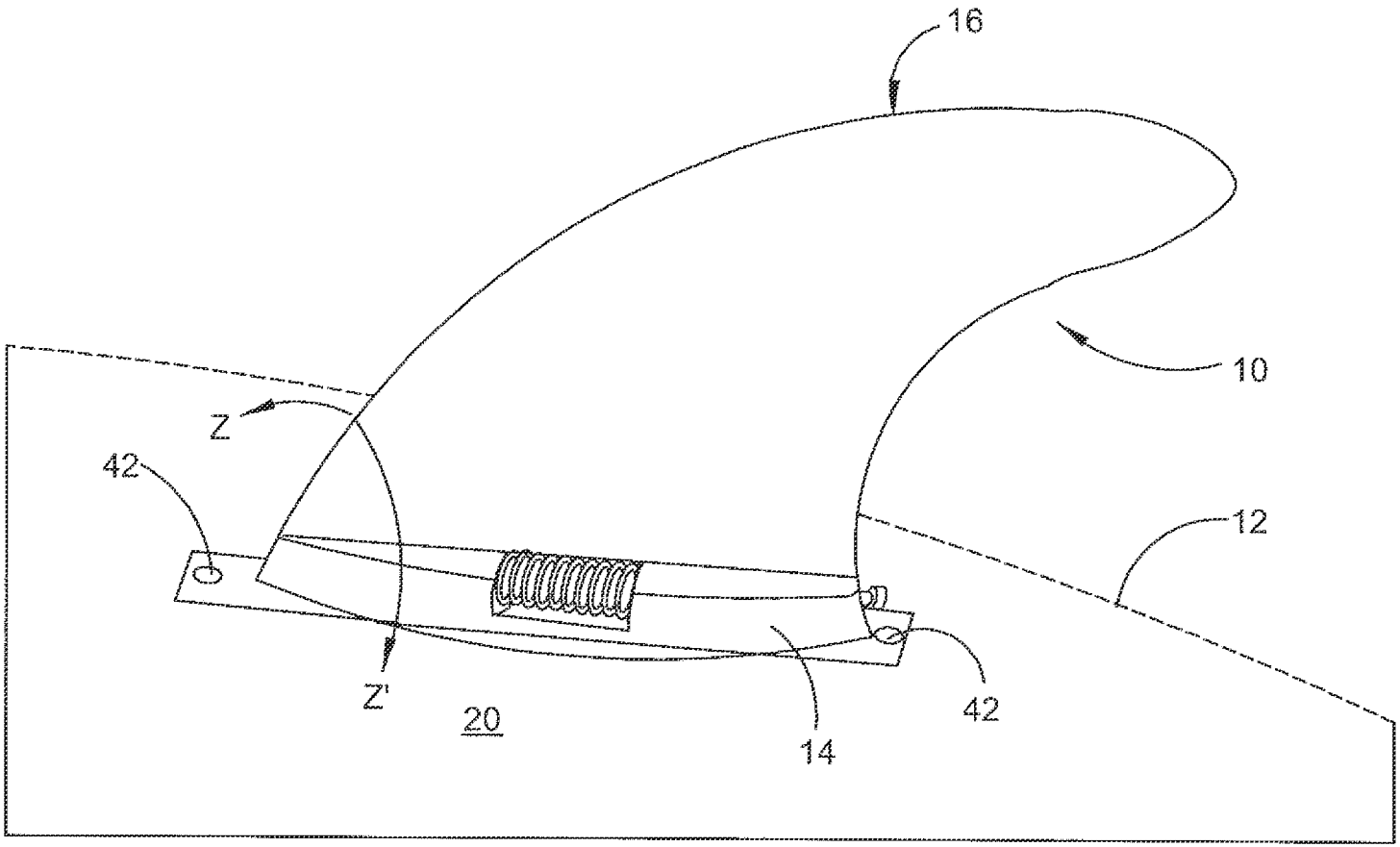
FIG. 3 is a side view of the fin of FIG. 1.

The hinge tabs 24 and spring 22, as shown in FIG. 2, rotate about the axle or pin 28 in the direction indicated by arrow Z, the hinge tabs 24 and spring 22 being received in notches 30 in the base 14. However, the notches 30 are provided on only one side of the base 14 (see FIG. 3). Accordingly, the fin 16 cannot rotate in the direction of arrow Z', as the abutment between the hinge tabs 24 and side 26 of the base 14 prevent rotation. Notches 30 are also referred to as an aperture or recess at various points in this description.

It will be appreciated that either one of the base 14 and fin 16 can be provided with tabs or projections and the other of the base 14 and fin 16 can be provided with notches, or a combination of the two. In the embodiment shown, the base 14 comprises three apertures or notches 30 and the fin 16 comprises two extensions or projections 24. The spring 22 and the two projections 24 are received in the notches 30 in the base 14 with the spring 22 being positioned between the two projections 24. This arrangement helps to stabilise the hinge 18 as consistent support is provided on either side of the spring 22.

It will also be appreciated that any appropriate number of projections or tabs 24 may be provided, to be received in a corresponding number of notches 30. Thus, one of the base 14 and fin 16 is provided with at least one recess (e.g. recess 30 in the base 14) and the other of the base 14 and fin 16 is provided with at least one projection (e.g. projection 24 on the fin 16) shaped to be received in the or each recess. Preferably, there are provided at least three recesses 30 and at least two projections 24, such that the projections 24 occupy two of the recesses 30 and a portion of the hinge 18 (e.g. spring 22) can occupy the third such recess 30.

In effect, the base 14 and fin 16 are provided with interleaving projections 24 such that one of the base 14 and fin 16 can be provided with two or more such projections 24 and the other of the base 14 and fin 16 is provided with one or more such projections 24 interleaving the two or more such projections 24.

The ability of the fin 16 to rotate between first and second conditions in one pivot direction Z and not the other pivot direction Z' means the fin 16 controls rotation of the surfboard 12 in one direction but, by overcoming the bias of the spring 22, permits free rotation of the surfboard 12 in the other direction.

To allow rotation of the fin 16 in the first pivot direction Z, and to prevent rotation of the fin 16 in the second pivot direction Z' opposite to the first pivot direction Z, the base 14 is provided with a stop, in the present case side walls 26 forming a longitudinal flange extending from the base 14. The stop 26 prevents the fin 16 from pivoting in one rotational direction from the first condition.

Side walls 26 are one example of an abutment preventing movement of the fin 16 in a particular direction and various other configurations of notches 30, projections 24 and walls 26, and innumerable other features having similar purposes, can be used to achieve the desired function of the fin assembly 10: namely, to allow rotation of the fin 16 in a first pivot direction Z and to prevent rotation of the fin 16 in a second pivot direction Z' opposite the first pivot direction Z when the fin 16 is in the first condition. It will be understood that the stop or walls 26 may be provided on either of the base 14 and fin 16 to achieve that desired function, and that the stop or walls 26 will generally, but not always, extend in a longitudinal direction of the body 12 (being the direction from the rear of the body 12 to the front of the body 12 generally up the centre of the body 12).

Figure 4:
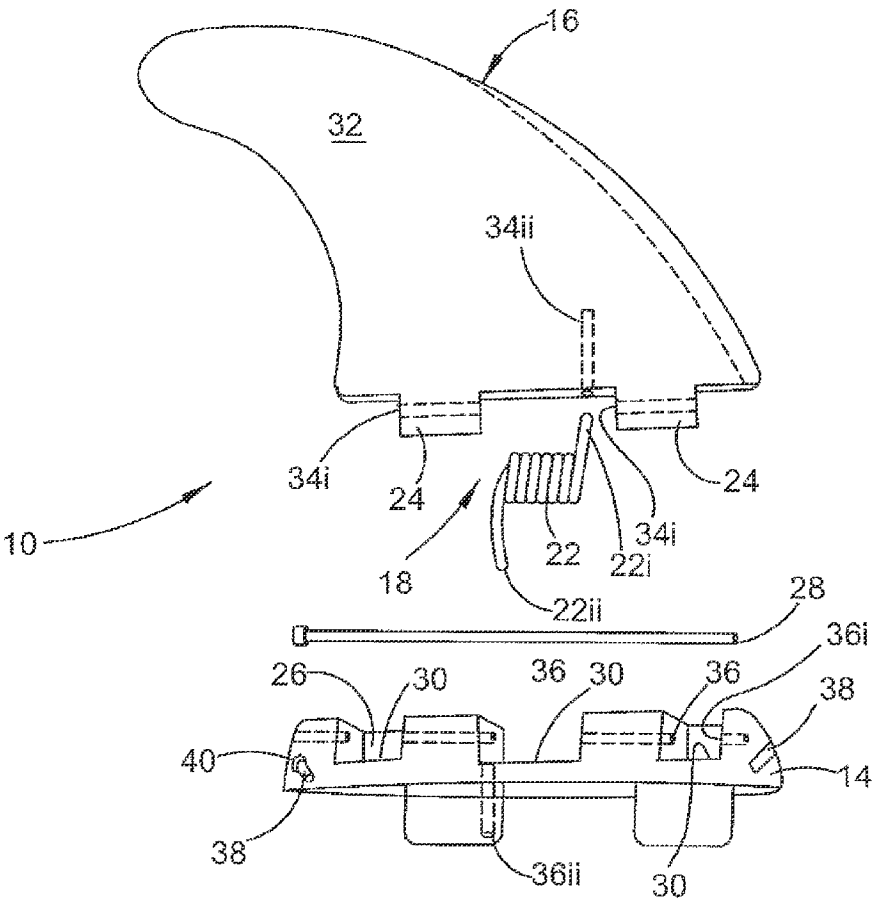
FIG. 4 is an exploded view of a fin assembly.

The components of the fin assembly 10, as shown in FIG. 4, include a fin 16 having a blade 32 against which a force is applied by the water over which the surfboard 12 travels, the fin 16 thereby stabilising and providing the surfer with control over the surfboard 12.

The fin 16 further includes hinge tabs 24 with a bore **34*i* extending therethrough for receiving a pin 28, and a spring bore 34*ii* that is closed at one end and extends into the fin 16: the spring bore 34*ii* being shaped to receive a first end or end portion 22*i* of the spring 22**.

The base 14 also includes a bore **36*i* which, when the fin assembly 10 is assembled, is coaxial with the bore 34*i* through the hinge tabs 24. The pin 28 thus extends through projections 24 in the fin 16 and base 14 by passing through both bores 34*i*, 36*i*, and through the centre of the spring 22, thereby holding the fin 16 in rotatable relation to the base 14**.

Figure 10:
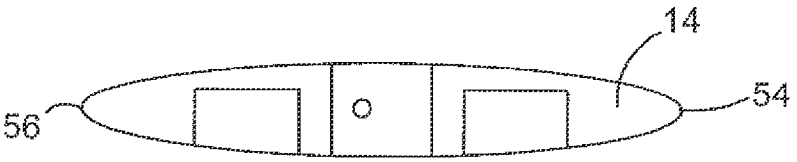
FIG. 10 shows a top view of a base of a fin assembly.

The base 14 further includes a broad rear end 54 and narrow front end 56 as shown in FIG. 10. The narrow front end 56 generally conforms with the shape of the fin 16 and the broad rear end 54 ensures the base 14 is strong in the region of the head of the pin 28, thereby reducing the possibility of the pin 28 damaging the base 14 while ensuring the head of the pin 28 is within the base 14.

The base 14, as shown in FIG. 4, further includes a spring bore **36*ii*, for receiving a second end or end portion 22*ii* of the spring 22, and threaded bores 38 each having one open end 40 for receiving a screw (not shown). The threaded bores 38 cooperate with threaded bores 42 (see FIGS. 1 to 3) in the surfboard 12, to hold the fin assembly 10 to the surfboard 12 when a corresponding threaded member (not shown), e.g. a screw, is inserted into the cooperating bores 38, 42**.

The fin 16 and base 14 are attached to the spring 22, or the spring 22 is mounted to, or retained by, the base 14 and fin 16, by receiving the end portions **22*i*, 22*ii* thereof in the spring bores 34*ii* and 36*ii* respectively. The fin 16 is also attached to the pin 28 by a friction fit between the pin 28 and the bore 34*i* through the hinge tabs 24, thus the pin 28 cannot rotate in that bore 34*i*. However, the pin 28 can freely rotate in the bore 36*i* of the base 14 and as such when an external force (e.g. applied by water over which the surfboard 12 travels) is applied to the fin 16 to cause it to rotate, end portion 22*i* of the spring 22 rotates with respect to end portion 22*ii*, thereby building up force in the spring 22. When the external force is no longer applied, or is too small to overcome the spring tension, the fin 16 returns to the first condition, in which the plane of the fin 16 is substantially perpendicular to the plane of the body 12**.

It will be appreciated that the friction fit between the pin 28 and fin 16 can be such that removal of the pin 28 from the assembly is possible, and thus the entire assembly can be disassembled for the purposes of cleaning and repair. Disassembly also enables the orientation of the fin 16 to be swapped (i.e. change the fin from being a left-handed fin to a right-handed fin, handedness being discussed below), which simply requires that the base 14 be able to receive the hinge tabs 24 of the fin 16 such that the bores 34*i*, 36*i* are in alignment, when the fin 16 is in either orientation. It will also be appreciated that the spring 22 and pin 28 may be permanently fastened to the fin 16 and/or bore 14 (e.g. by adhesive).

Figure 5:
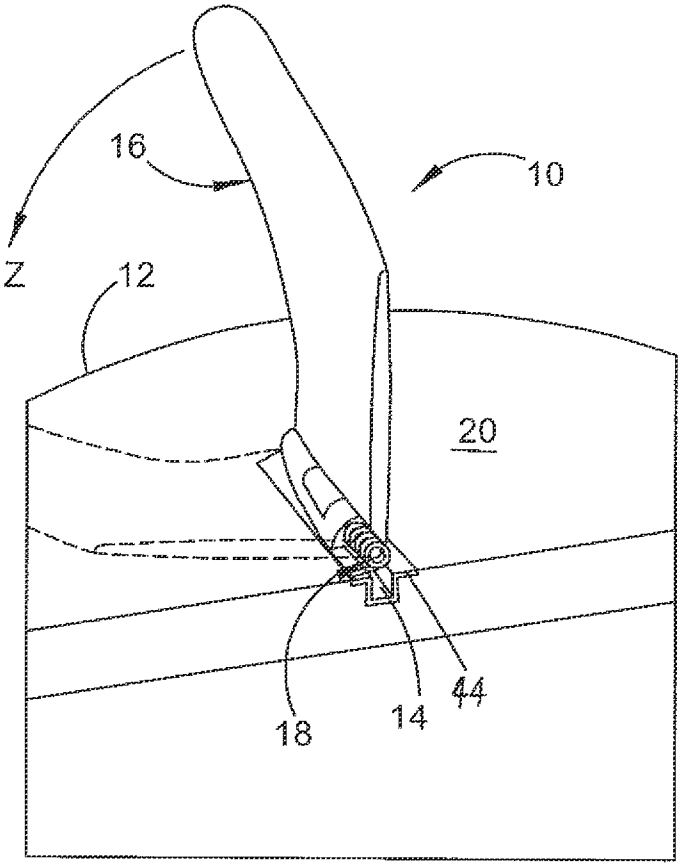
FIG. 5 is a partial cross-sectional view of a surfboard including a fin assembly.

A surfboard 12, as shown in FIG. 5, includes a groove 44 for receiving at least a portion of the base 14 of the fin assembly 10 which is removably attachable to the body 12 in the same manner as known removable fins. The hinge 18 is mounted above the bottom surface 20 of the surfboard 12 so that, when the fin 16 has pivoted into the second condition (as indicated by the broken lines), the blade 32 of the fin 16 is substantially parallel to, lies against, is flat, or abuts the bottom surface 20 of the surfboard 12. For example, the plane of the fin 16 may be substantially parallel with the plane of the body 12 when the fin 16 is in the second condition.

Figure 6:
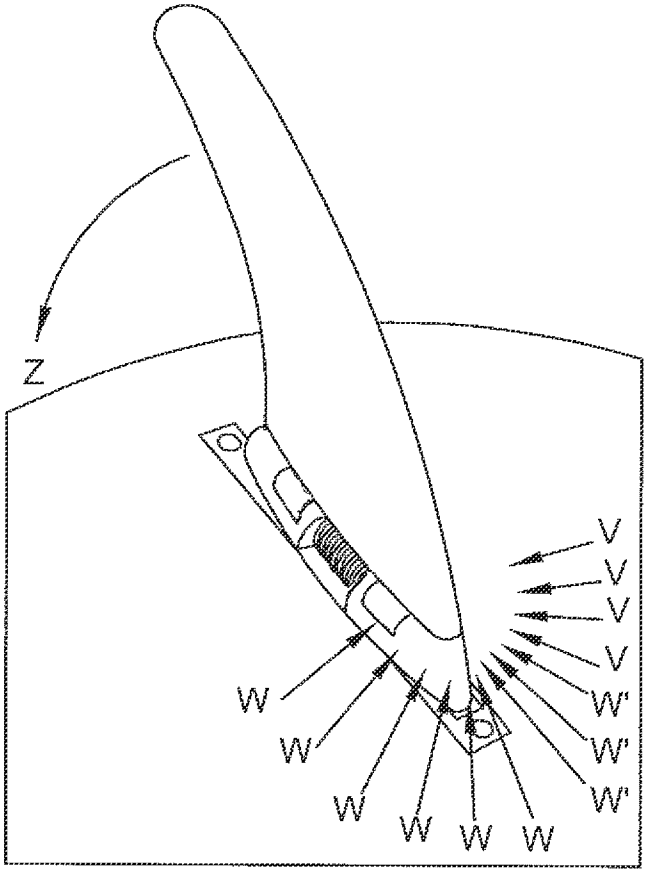
FIG. 6 is a bottom view of a surfboard and fin assembly.

When the surfboard 12 moves over water, the fin 16 applies a force to the oncoming water so as to stabilise the surfboard 12. Water arriving from the directions indicated by arrows W, W' as shown in FIG. 6, will apply a force to the fin 16 to push the hinge tabs 24 against the side 26 of the base 14. Accordingly, the fin 16 remains in the first condition and functions as would be expected of a normal fin. However, when water approaches from, for example, the direction indicated by arrows V, the force of the fin 16 against the water overcomes the bias of the spring 22 and the fin 16 pivots to a position more coplanar with the bottom 20 of the surfboard 12. In so doing, the fin 16 no longer prevents the rear 46 of the surfboard 12 from freely rotating, and thus the user can make the surfboard 12 spin or slide as if no fin 16 were attached thereto. A similar principle applies to cases where multiple fins 16 are attached to the surfboard 12, such as when using a thruster fin configuration.

It will be noted that water arriving in the direction of arrows W' approaches the fin 16 on the same side of the blade 32 as water arriving in the direction of arrows V. However, the water arriving in the direction of arrows W' does not provide sufficient force against the fin 16 to overcome the spring bias and thus the fin 16 behaves as normal. Though a spring 22 with a lesser spring constant (e.g. a smaller spring bias) can be used so that water arriving from one side of the fin 16 causes it to remain in the first condition and any water arriving from the other side of the fin 16 causes it to rotate into the second condition, this is undesirable. In particular, it is preferred that some degree of force be required to cause the fin 16 to rotate to the second condition so that the user is not entirely restricted to rotation in one direction and controlled movement in the other. Instead, complete control in one direction and a degree of rotational control in the other is generally desirable.

Figure 7:
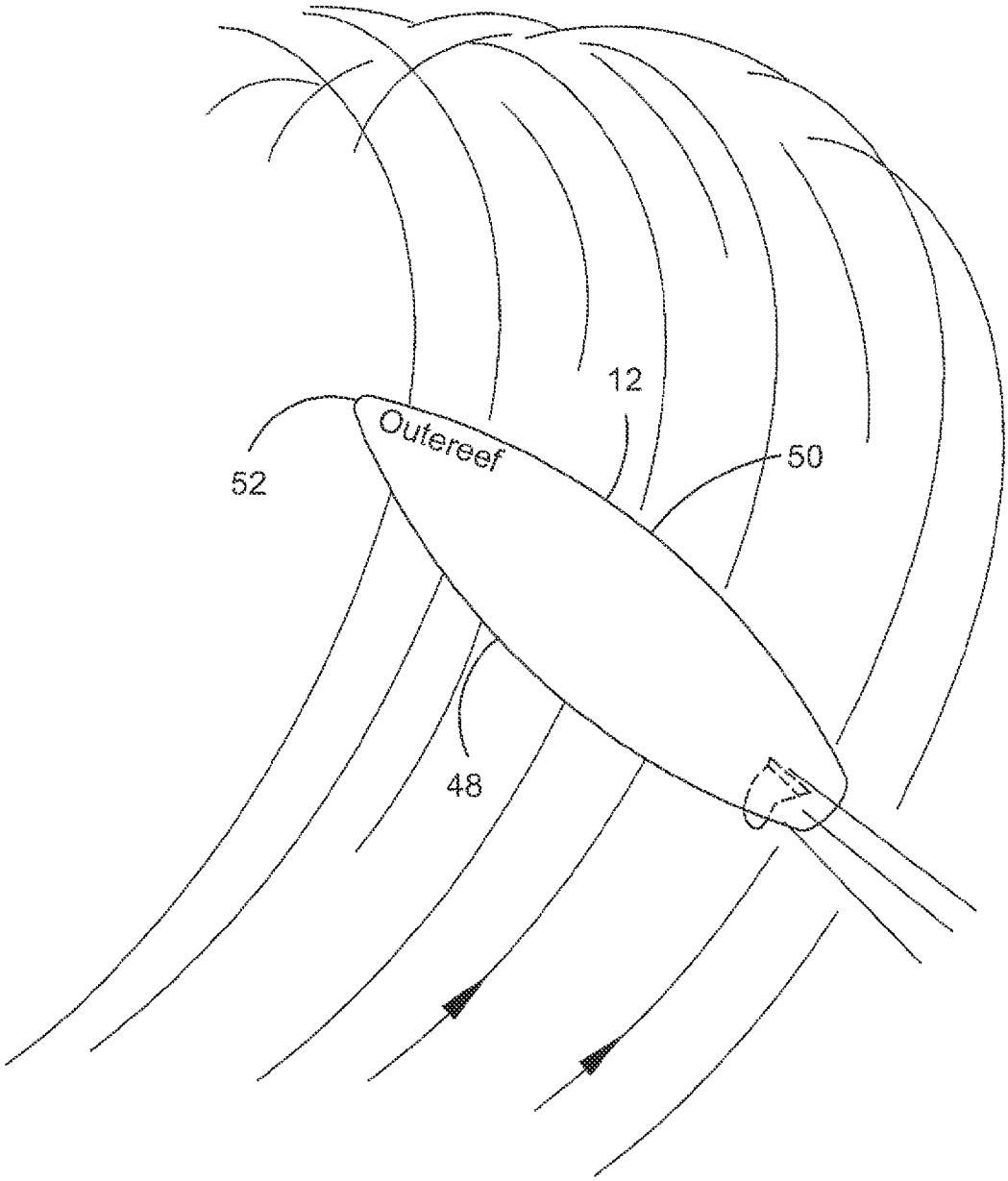
FIG. 7 is a view of a surfboard on a wave.

The force of the water against the fin 16, or the force the fin 16 applies to the water, is what overcomes the spring bias. Accordingly, the direction in which the fin 16 rotates to the second condition is pivotal when riding waves, as the water will approach the surfboard 12 from a different side, depending on whether a right-handed or left-handed wave is being ridden. In this regard, a surfboard 12, as shown in FIG. 7, is on a right-handed wave. Accordingly, water travelling to form the wave is moving from the left side 48 of the surfboard to the right side 50, and a surfer will tend to dig the edge of the right side 50 into the wave to maintain their height on the surface of the wave. Therefore, a fin assembly 10 suitable for a right-handed wave will be used, in which the second condition requires the fin 16 to fold or rotate towards the oncoming water. As such, whilst surfing along the wave as normal, the water flowing to form the wave applies a force to ensure the fin 16 remains in the first condition, and rotation of the surfboard 12 is controlled.

Figure 8:
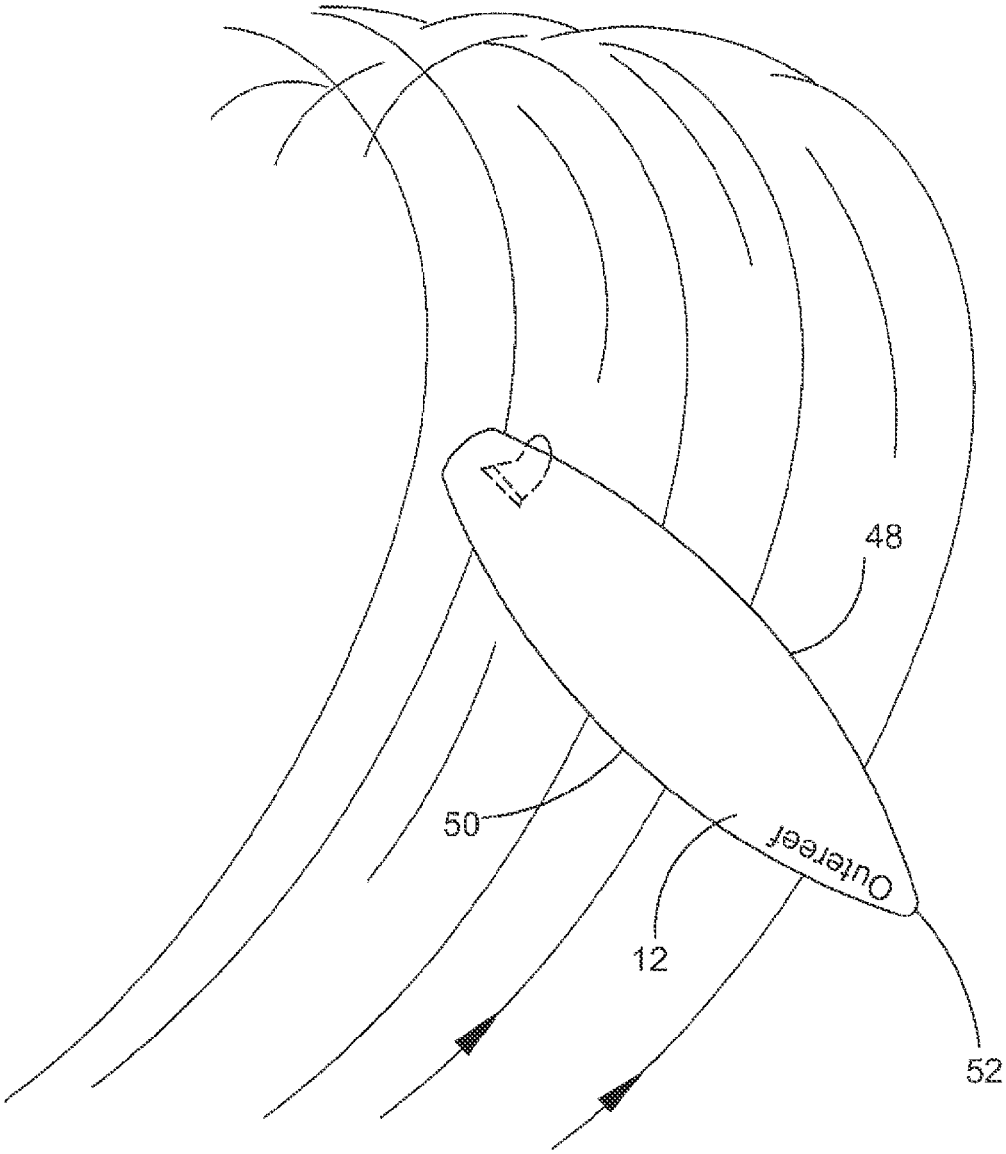
FIG. 8 shows a surfboard on a wave, during rotation.

When the surfer turns the front 52 of the surfboard 12 up the wave, control is provided as per a normal fin. Similar control is provided, though to a lesser degree, for movement of the front of the surfboard 12 down the wave. However, sharply urging the rear 46 of the surfboard 12 up with the flow of water, as shown in FIG. 8, causes the application of a force to the fin 16 which overcomes the spring bias and thus allows the surfboard 12 to freely rotate as if no fin 16 were attached thereto. Accordingly, free rotation will generally be achieved by rotating the rear 46 of the surfboard 12 to a higher position on the wave. Such surfboard 12 orientation occurs when performing manoeuvres such as 360° turns and sliding manoeuvres.

Upon realigning the surfboard 12 to travel in a straight line or rotate in the opposite direction, the spring bias forces the fin 16 back to the first condition, to re-establish rotational control of the surfboard 12. It should be noted that the force required to overcome the spring bias can be applied by the water or by the surfer manoeuvring the rear 46 of the surfboard 12 in the direction of the flow of water forming the wave, or by a combination of the two.

Figure 9:
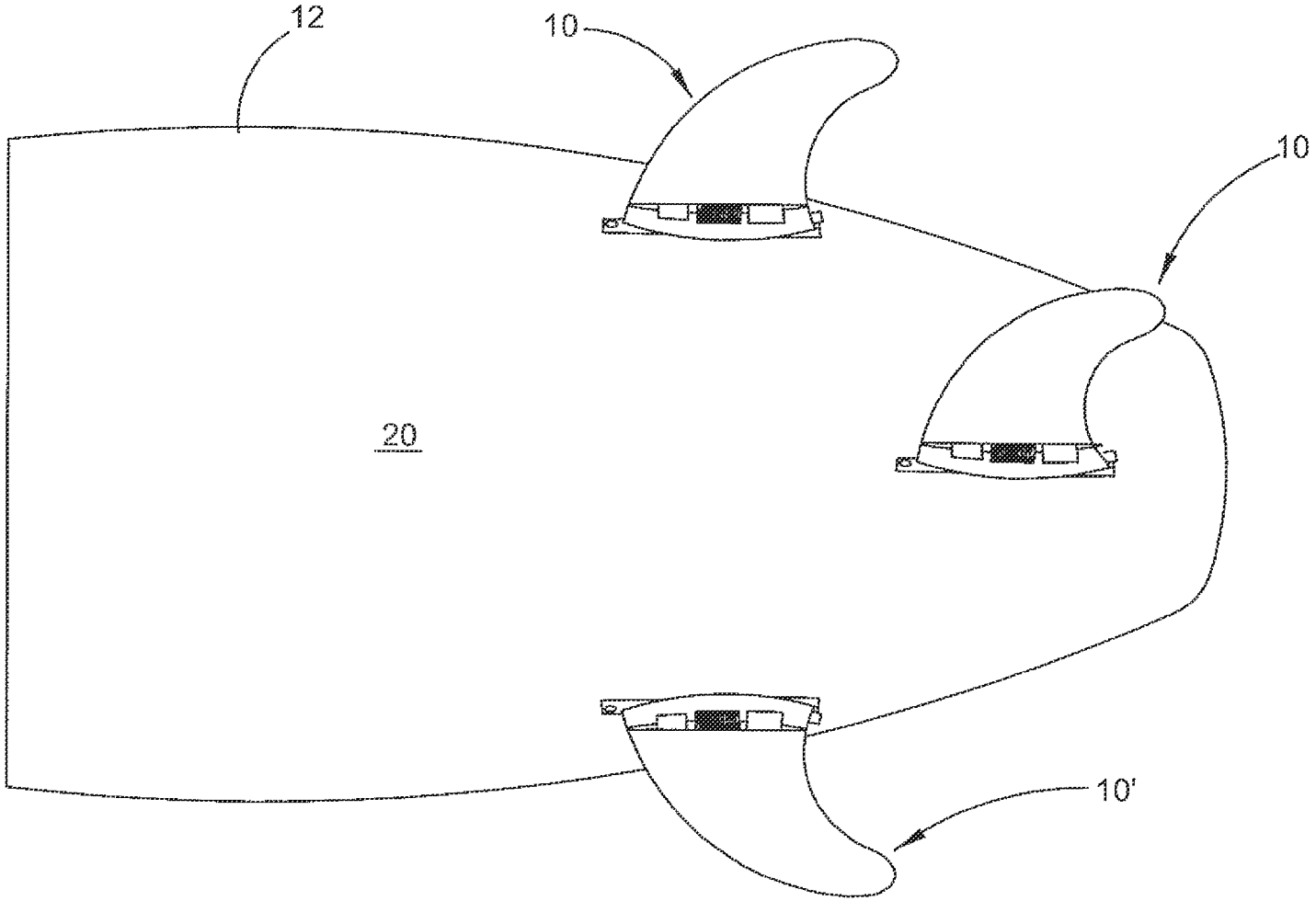
FIG. 9 is a bottom view of a surfboard with a thruster fin configuration.

As the fin 16 rotates in one direction only, two separate sets of fin assemblies 10, 10', as shown in FIG. 9, may be required to surf on both left and right-handed waves. Accordingly, removability of the fins 16 is desirable so that the fin assemblies 10 of an appropriate orientation (i.e. appropriate direction of rotation of the fin 16 to the second condition) can be selected for a particular wave. For the purpose of illustration, the surfboard 12 has a thruster fin configuration, as shown in FIG. 9, and includes both left and right-handed fin assemblies 10, 10'. In practice, such a configuration will likely not be used as free rotation in either rotational direction will be inhibited by one or more of the fins 16 at all times.

In addition, liability in relation to hire boards can be reduced using the fin assemblies 10, 10' as described herein. In particular, as the fin 16 rotates in one direction, being hit by the fin 16 (e.g. after having fallen off the surfboard 12) can cause the fin 16 to rotate out of the way, rather than remaining rigid. Thus the result of injuries from such collisions can be reduced.

The hinge 18 may not employ a spring 22 as shown, but may instead be a flexible material that simply bends in response to an applied force. The flexible material can be integrally formed with one or both of the base 14 and fin 16. The base 14 and fin 16 may also form a continuous body of material, with the hinge 18 at least partially formed by one or more of: a thinning of material; a weakening of material; and a different material to that of the base 14 and fin 16. In this regard, the hinge 18 may comprise a combination of a spring 22 (or other mechanism) and a body of material integral with the base 14 and/or fin 16.

The hinge 18 may not be biased but may instead provide general resistance to movement of the fin 16 in either direction Z, Z' while preventing movement of the fin 16 in the pivot direction Z' when the fin 16 is in the first condition. For example, the hinge 18 may apply an appropriate amount of friction that resists movement of the fin 16 relative to the base 14 generally. Other alternatives will be apparent to the skilled person and are intended to fall within the scope of the present disclosure.

Moreover, the spring tension of the spring 22 may be adjusted for a particular purpose. For example, when surfing on small waves, using light surfboards 12, or when smaller, younger or lighter surfers are using the surfboards 12, a lighter spring tension may be desirable so that less force is required to rotate the fin 16 into the second condition. On the other hand, for larger waves and larger surfers, a higher spring tension can be desirable so that general control is still afforded, yet when a considerable force is applied to spin the surfboard 12, the fin 16 rotates into the second condition and allows that rotation to occur freely.

There is some variance in the position of the hinge 18 in relation to the underside 20 of the surfboard 12. For example, the hinge 18 may be so placed that the fin 16 does not abut the underside 20 of the surfboard 12 but instead lies in a plane parallel to, but just below, the underside 20. The fin 16 may also turn through an angle greater/less than 90° so that it angles towards/away from the underside 20 of the surfboard 12.

There is no limitation to the number of fin assemblies 10, 10' useable in conjunction with buoyant bodies 12, nor are the dimensions of the fins 16 themselves in any way restricted. Rather, the dimensions of the fins 16 and their number can be selected as per selection of normal fins.

Figure 11:
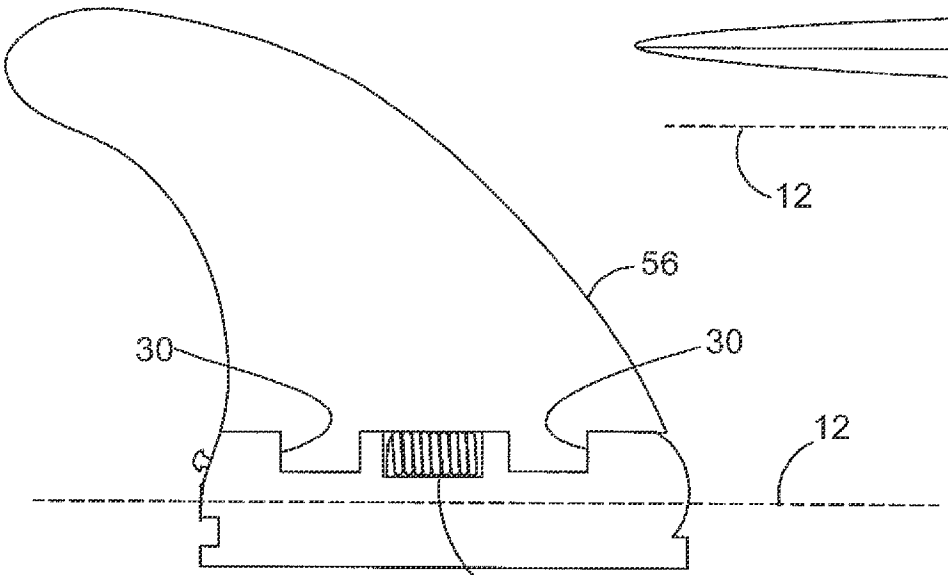
FIG. 11 shows a fin assembly in place in a surfboard.

In addition, the base 16 may extend from the body 12 and the fin 16 may extend from the base 14. While not essential, it would be preferred that the base 14 and fin 16 together have the shape of a traditional or rigid fin when the fin 16 is in the first condition, such as is shown in FIG. 11 in which the front end 56 of the base 14 forms a smooth continuation of the fin 16 down to the surface of the surfboard 12.

Though the description relates to fin assemblies 10, 10' removably attachable to buoyant bodies 12, this is for the purpose of illustration only and in any event, it is desirable to be able to select the direction of rotation of the fin 16 for the desired purpose, rather than having to supply two buoyant bodies 12 with fins 16 that rotate in respectively different directions and thus removability of the fin assembly 10 is generally desirable. It will be appreciated that the base 14 can be integrally formed, or otherwise moulded, with the buoyant body 12, and the fin 16 may be integrally formed with the base. Removability of the fin assemblies 10, 10' also assists in the repair of same. It will be appreciated that any suitable attachment mechanism may be used in place on the cooperating threaded bores 40, 42, so as to hold the fin assembly 10, 10' to the buoyant body 12.

Figure 13:
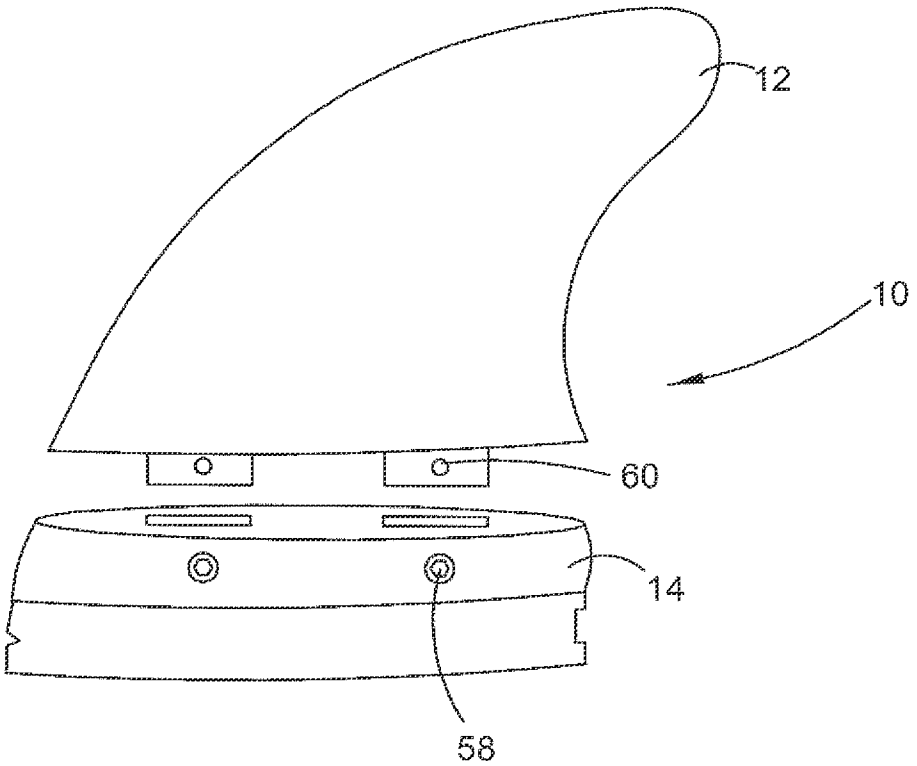
FIG. 13 shows an alternative fin assembly in accordance with the present invention.

With further regard to removability, as shown in FIG. 13, the fin assembly 10 may comprise a base 14 and fin 12 connected to each other by fasteners 58 that extend through orifices 60 when the fin 12 and base 14 are assembled. Such a fin assembly 10 allows the fin 12 to be exchanged for a different sized fin 12 as desired, or when a fin 12 becomes damaged, but when assembled forms a rigid assembly providing control similar to a traditional fin.

The description has been provided in relation to surfboards 12 for ease of illustrating the principles of the invention. However, it will be recognised that the fin assemblies 10, 10' can be applied to many other buoyant bodies 12 such as body boards, skis and more, without venturing outside the scope of the invention.

In addition, while the fin 16 as shown in the described embodiments stands substantially upright or erect from the body 12 when the fin 16 is in the first condition, the fin 16 may take another orientation with respect to the body 12 (e.g. a 5° to 6° offset as provided by side fins in a thrusters fin configuration).

It will be understood to persons skilled in the art of the invention that many modifications may be made without departing from the spirit and scope of the invention.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

The invention claimed is:

1. A fin assembly for controlling movement of a buoyant body, including:

a base for attaching the assembly to the buoyant body; and a fin attached to the base by a hinge, the hinge having a hinge tension that can be overcome by pressure applied by water, and wherein the hinge tension is provided by the hinge including a spring having a first end that is mounted in a bore in the fin and a second end that is mounted in a bore in the base;

wherein, when the assembly is attached to the buoyant body, the fin can pivot at the hinge in a first pivot direction from a first condition to a second condition under pressure applied by water from a first direction that overcomes the hinge tension to allow substantially free rotation of the buoyant body in a first rotational direction, and wherein the fin is prevented from pivoting from the first condition in a second pivot direction opposite the first pivot direction and resists water pressure, when water pressure is applied in a second direction opposite the first direction, wherein the fin stands substantially perpendicular to the buoyant body when the fin is in the first condition.

2. An assembly according to claim 1, wherein one of the base and fin includes a stop such that, when the fin is in the first condition, the stop bears against the other of the base and fin to prevent the fin from pivoting in the second pivot direction.

3. An assembly according to claim 2, wherein the stop is a longitudinal flange extending from the base.

4. An assembly according to claim 1, wherein a plane of the fin is substantially parallel to a plane of the buoyant body when the fin is in the second condition.

5. An assembly according to claim 1, wherein the hinge is biased to move the fin to either the first condition or the second condition.

6. An assembly according to claim 5, wherein the hinge is biased to move the fin to the first condition.

7. An assembly according to claim 1, wherein one of the base and fin is provided with two or more projections, and the other of the base and fin is provided with one or more projections, and wherein the one or more projections of the base interleave with the one or more projections of the fin.

8. An assembly according to claim 1, wherein the spring is mounted between projections in one or both of the base and fin.

9. An assembly according to claim 1, wherein the hinge comprises an axle extending through the base and fin, the fin rotating about the axle between the first condition and the second condition.

10. An assembly according to claim 9, wherein the hinge includes a spring, the axle extends through the base and fin and the axle is coaxial with an axis of the spring.

11. An assembly according to claim 9, wherein the axle extends through projections in the base and fin.

12. An assembly according to claim 1, wherein at least a portion of the base is adapted to be received in a recess in the buoyant body.

13. An assembly according to claim 1, wherein the assembly is removably attached to the buoyant body.

14. An assembly according to claim 1, wherein one or both of the base and fin are integrally formed with the buoyant body.

15. An assembly according to claim 1, wherein the base extends from the buoyant body and the fin extends from the base.

16. An assembly according to claim 1, wherein the buoyant body is a surfboard.

17. A fin assembly for controlling movement of a buoyant body, including:

at least two bases for attaching the assembly to the buoyant body; and at least two fins, each fin attached to one of the bases by a hinge, the hinge having a hinge tension that can be overcome by pressure applied by water, and wherein the hinge tension is provided by the hinge including a spring having a first end that is mounted in a bore in the fin and a second end that is mounted in a bore in the base;

wherein, when the assembly is attached to the buoyant body, each fin can pivot at the hinge in a first pivot direction from a first condition to a second condition under pressure applied by water from a first direction that overcomes the hinge tension to allow substantially free rotation of the buoyant body in a first rotational direction, and wherein each fin is prevented from pivoting from the first condition in a second pivot direction opposite the first pivot direction and resists water pressure when water pressure is applied in a second direction opposite the first direction, wherein the fins stand substantially perpendicular to the buoyant body when the fins are in the first condition, and wherein the fins pivot in the same first pivot direction to the second condition.

18. A surfboard comprising a buoyant body and the fin assembly claimed in claim 17 attached to an underside of the buoyant body.

* * * * *